US007712473B1

(12) United States Patent
Robinson et al.

(10) Patent No.: US 7,712,473 B1
(45) Date of Patent: May 11, 2010

(54) FINGERNAIL GEL CURATION APPARATUS

(76) Inventors: Stanwick C. Robinson, 4522 N. 48th St., Milwaukee, WI (US) 53218; Marian Robinson, 4522 N. 48th St., Milwaukee, WI (US) 53218

( * ) Notice: Subject to any disclaimer, the term of this patent is extended or adjusted under 35 U.S.C. 154(b) by 404 days.

(21) Appl. No.: 11/735,975

(22) Filed: Apr. 16, 2007

(51) Int. Cl.
*A45D 29/00* (2006.01)

(52) U.S. Cl. ..... 132/73

(58) Field of Classification Search ..... 132/73, 132/73.5, 73.6, 75, 76.2, 286, 288, 200; D28/54.1, D28/56; 250/492.1, 504 R; 34/275, 90; 601/17

See application file for complete search history.

(56) References Cited

U.S. PATENT DOCUMENTS 3,287,824 A * 11/1966 Selditz ..... 34/202
4,612,444 A 9/1986 Ragusa
4,731,541 A 3/1988 Shoemaker
4,754,769 A 7/1988 Flynn
4,979,523 A 12/1990 Grimm
5,130,551 A 7/1992 Nafziger et al.
5,130,553 A * 7/1992 Amoh ..... 250/492.1
5,249,367 A * 10/1993 Nafziger et al. ..... 34/275
6,532,969 B2 * 3/2003 Nuzzo ..... 132/286
6,708,697 B1 * 3/2004 Ziff ..... 132/73
6,762,425 B1 * 7/2004 Strait ..... 250/504 R

* cited by examiner

*Primary Examiner*—Cris L Rodriguez
*Assistant Examiner*—Rachel R Steitz
(74) *Attorney, Agent, or Firm*—Crossley Patent Law; Mark A. Crossley

(57) ABSTRACT

A fingernail gel curation apparatus that allows an individual to rapidly cure and dry fingernail gel that has been applied to their fingertips, thereby saving time for individuals and preventing unnecessary ultraviolet light exposure. The apparatus includes a base and two folding upper lid portions that are pivotally attached to the base. The base and each of the upper lid portions each have a UV light that is protected by glass layer so personal contact is not made. When the upper lid portions are closed over the base, a hand hole is present to allow an individual to insert their hand through in order to receive UV light being emitted from the UV lights within the apparatus. The UV light will help to dry fingernail gel applied to the individual's fingernails in a faster manner than doing nothing, thereby saving an individual time.

1 Claim, 3 Drawing Sheets

FINGERNAIL GEL CURATION APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved fingernail gel curation apparatus that allows an individual to rapidly cure and dry fingernail gel that has been applied to their fingertips, thereby saving time for individuals.

DESCRIPTION OF THE PRIOR ART

U.S. Pat. No. 4,731,541, issued to Shoemaker, discloses a light system for providing uniform actinic radiation to fingernails while in a predetermined position.

U.S. Pat. No. 4,979,523, issued to Grimm, discloses a device for providing essentially uniform UV irradiation of all of the nails of all the fingers of one hand of an individual.

U.S. Pat. No. 5,130,551, issued to Nafziger et al., discloses a nail drying apparatus by which any commercially available nail polish of any color can be dried after being applied to a person's finger or toe nails.

U.S. Pat. No. 4,612,444, issued to Ragusa, discloses a cosmetic apparatus for curing a UV sensitive coating and bonding material applied to the surface of a person's fingernail.

U.S. Pat. No. 4,754,769, issued to Flynn, discloses a nail dryer that includes a clamshell shaped base for resting a user's hand thereon.

SUMMARY OF THE INVENTION

The present invention concerns that of a new and improved fingernail gel curation apparatus that allows an individual to rapidly cure and dry fingernail gel that has been applied to their fingertips, thereby saving time for individuals and preventing unnecessary ultraviolet light exposure. The apparatus includes a base and two folding upper lid portions that are pivotally attached to the base. The base and each of the upper lid portions each have a UV light that is protected by glass layer so personal contact is not made. When the upper lid portions are closed over the base, a hand hole is present to allow an individual to insert their hand through in order to receive UV light being emitted from the UV lights within the apparatus. The UV light will help to dry fingernail gel applied to the individual's fingernails in a faster manner than doing nothing, thereby saving an individual time.

There has thus been outlined, rather broadly, the more important features of a fingernail gel curation apparatus that the detailed description thereof that follows may be better understood and in order that the present contribution to the art may be better appreciated. There are, of course, additional features of the fingernail gel curation apparatus that will be described hereinafter and which will form the subject matter of the claims appended hereto.

In this respect, before explaining at least one embodiment of the fingernail gel curation apparatus in detail, it is to be understood that the fingernail gel curation apparatus is not limited in its application to the details of construction and to the arrangements of the components set forth in the following description or illustrated in the drawings. The fingernail gel curation apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present fingernail gel curation apparatus. It is important, therefore, that the claims be regarded as including such equivalent constructions insofar as they do not depart from the spirit and scope of the present invention.

It is therefore an object of the present invention to provide a fingernail gel curation apparatus which has all of the advantages of the prior art and none of the disadvantages.

It is another object of the present invention to provide a fingernail gel curation apparatus which may be easily and efficiently manufactured and marketed.

It is another object of the present invention to provide a fingernail gel curation apparatus which is of durable and reliable construction.

It is yet another object of the present invention to provide a fingernail gel curation apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
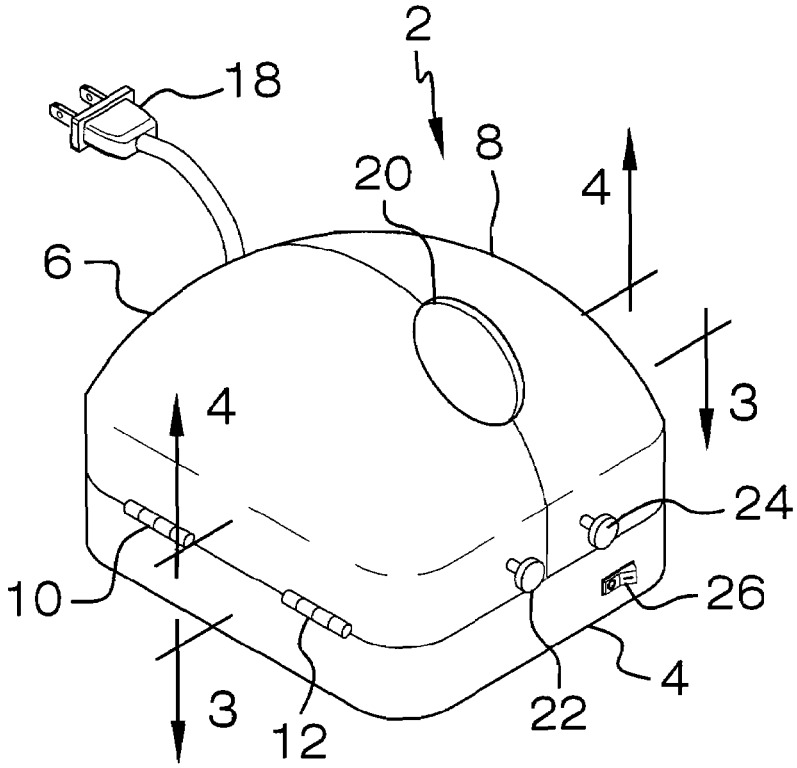
FIG. 1 shows a perspective view of the fingernail gel curation apparatus as it appears ready for use.
Figure 2:
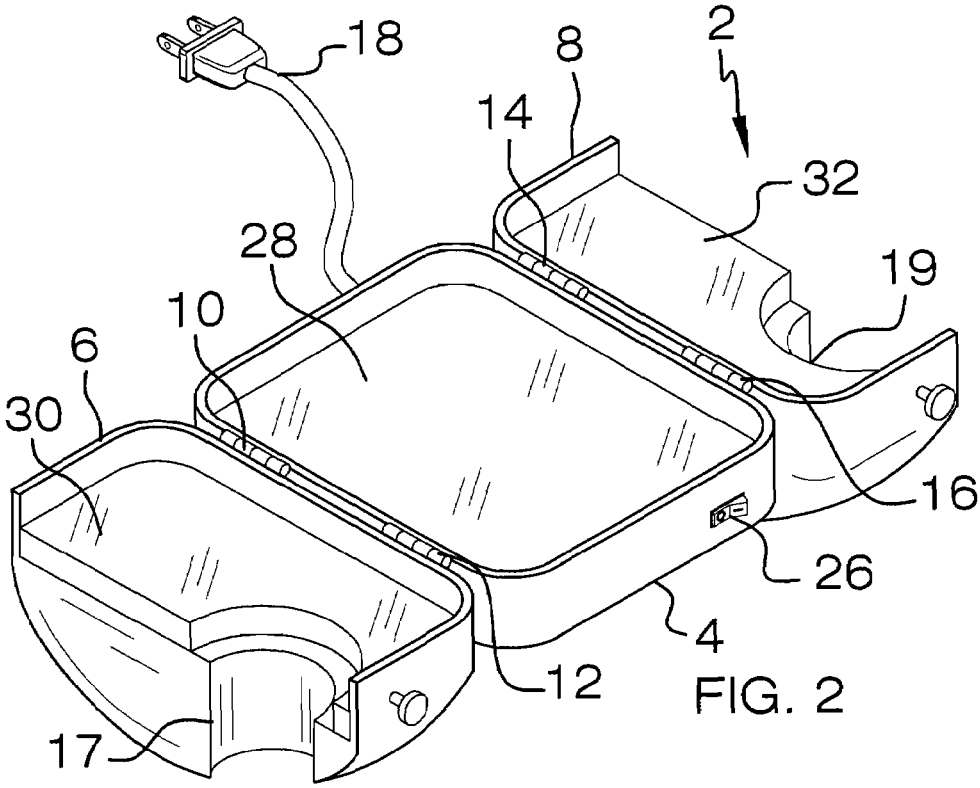
FIG. 2 shows a perspective view of the fingernail gel curation apparatus as it appears with the two upper lid portions opened up.
Figure 3:
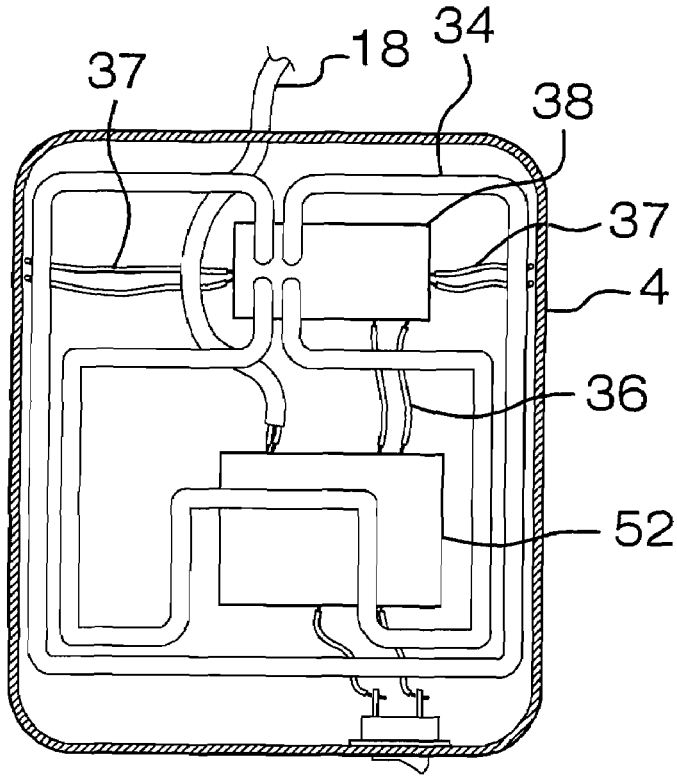
FIG. 3 shows a bottom cutaway view of the base of the fingernail gel curation apparatus, highlighting the UV light within the base and the electrical connections present.
Figure 4:
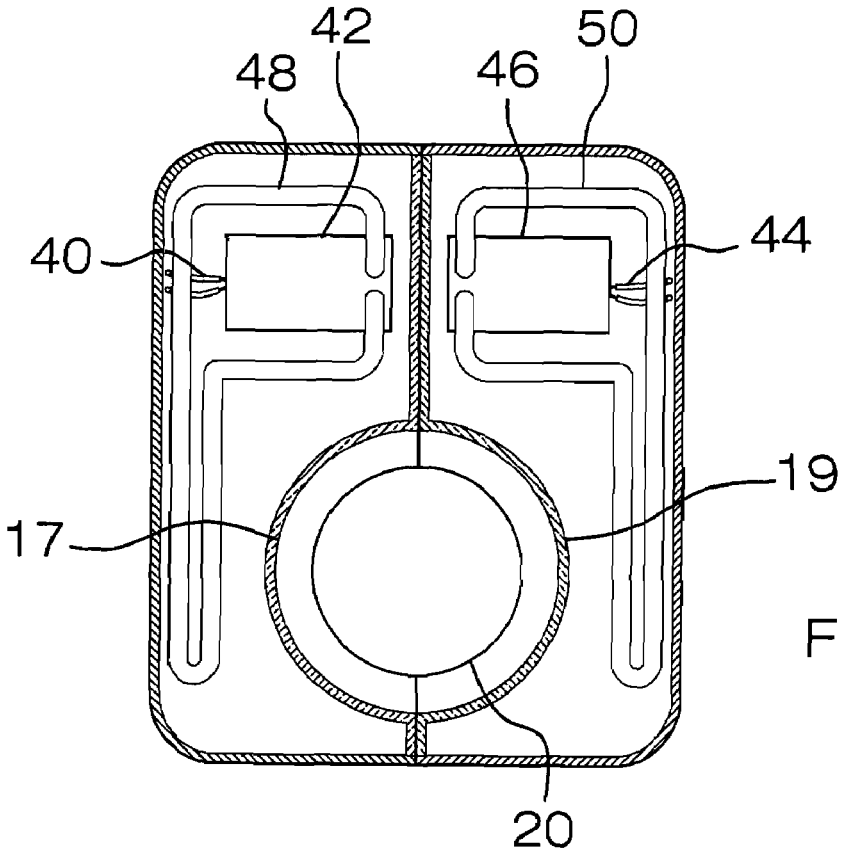
FIG. 4 shows a top cutaway view of the two upper lid portions of the fingernail gel curation apparatus, highlighting the two UV lights within the upper lid portions and the electrical connections present.
Figure 5:
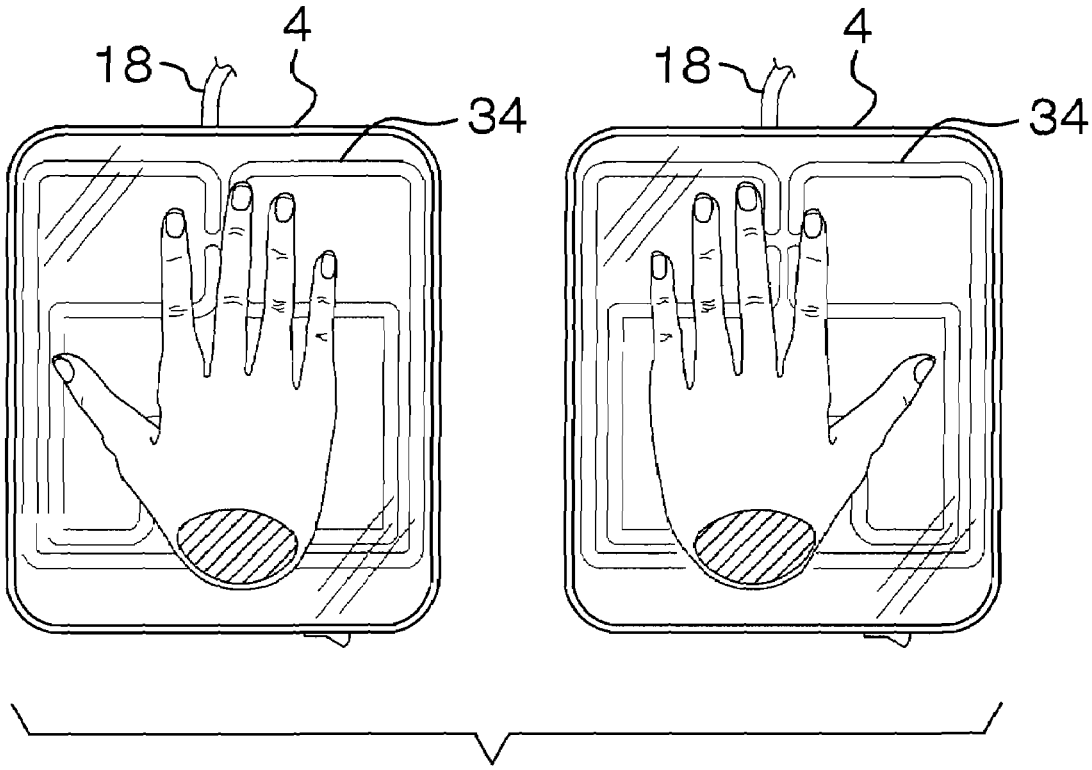
FIG. 5 shows a top representational view of the fingernail gel curation apparatus as it would appear in use with a pair of hands.
Figure 6:
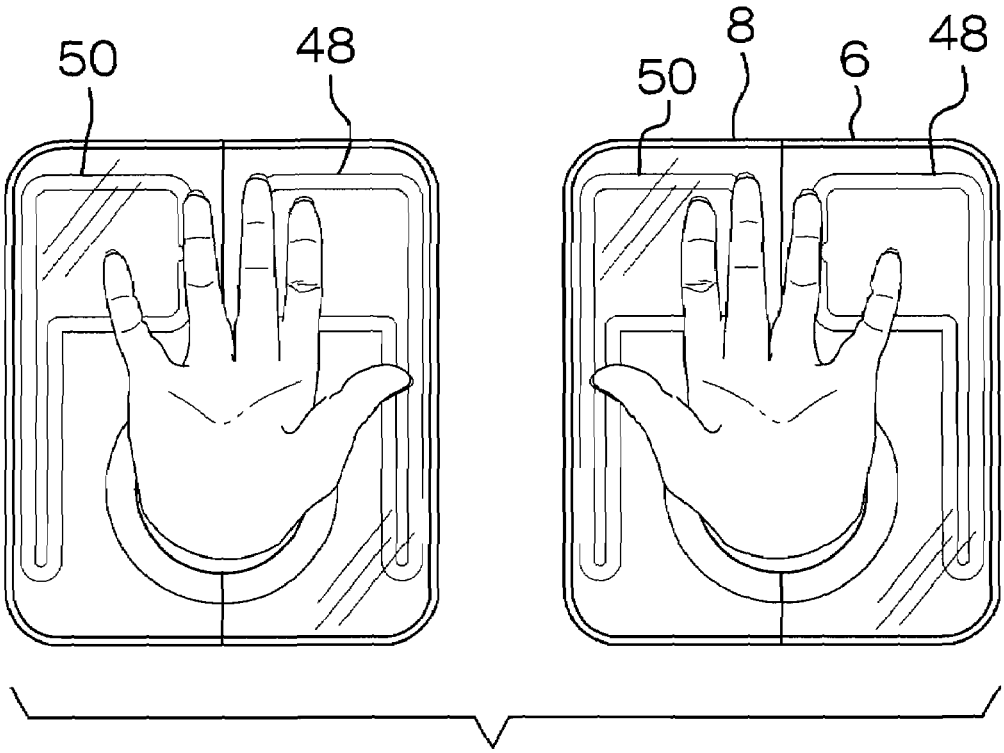
FIG. 6 shows a bottom representational view of the fingernail gel curation apparatus as it would appear in use with a pair of hands.

With reference now to the drawings, and in particular to FIGS. 1 through 6 thereof, a new fingernail gel curation apparatus embodying the principles and concepts of the present invention and generally designated by the reference numeral 2 will be described.

As best illustrated in FIGS. 1 through 6, the fingernail gel curation apparatus 2 comprises a base 4 that includes an internal UV light 34 and a glass base 28 that covers the UV light 34. The base 4 itself, while possibly being any one of a number of shapes, is preferably rectangular in shape. The UV light 34 that is located within the base 4 is preferably set up analogous to a halogen light, thereby allowing the UV light to be evenly dispersed over the surface area above the glass base 28.

The UV light 34 within the base 4 is preferably powered by a plug 18 that is connected to standard household current. Plug 18 itself is connected to power controller 52, which is connected to power connector 38 by wires 36. Power connector 38 itself is connected to UV light 34 through wires 37.

The power traveling from the plug 18 to the UV light 34 can be controlled through use of on/off switch 26, which is attached to the base 4 and is connected to the power controller 52. On/off switch 26 acts as a circuit in between power controller 52 and the connector 38. The on/off switch 26 itself is a two-position switch with an "on" position and an "off" position. When in the "on" position, the switch 26 acts as a closed circuit, thereby allowing power to travel between the power controller 52 and the connector 38, thereby allowing the UV light 34 to receive power and emit ultraviolet light. When in the "off" position, the switch 26 acts as an open circuit, thereby preventing power from traveling between the power controller 52 and the connector 38, thereby preventing the UV light 34 from receiving power and emitting ultraviolet light.

Left upper door 6 and right upper door 8 are pivotally attached to the base, with left upper door 6 being pivotally attached through use of hinges 10 and 12 and right upper door 8 being pivotally attached through use of hinges 14 and 16. Door 6 has semi-circular indentation 17 and door 8 has semi-circular indentation 19, which when put together, create a hand hole 20 that allows an individual to put their hand through. The two indentations 17 and 19 would be put together once the two doors 6 and 8 are wrapped around to rest on top of the base 4, at which time, the two doors 6 and 8 are flush with one another.

Left upper door 6 has an internal UV light 48, with the light 48 being powered by power source 42. A number of wires 40 connect the light 48 to the power source 42. A glass top 30 covers the UV light 48 in order to prevent accidental contact with the UV light 48 by an individual's hands.

Right upper door 8 has an internal UV light 50, with the light 50 being powered by power source 46. A number of wires 44 connect the light 50 to the power source 46. A glass top 32 covers the UV light 50 in order to prevent accidental contact with the UV light 50 by an individual's hands.

In order to assist an individual with opening and closing the doors 6 and 8 in relation to the base, a pair of knobs 22 and 24 are attached to the doors 6 and 8, respectively. Left knob 22 is attached to door 6, while right knob 24 is attached to door 8. An individual can just grasp a knob and then use this handling to move the respective door to its desired position.

Once an individual has had fingernail gel applied to their fingernails, it frequently takes awhile for the gel to thicken and harden. Use of ultraviolet lights generates both energy and heat and helps speed up the process of drying this applied fingernail gel. However, ultraviolet light is not the safest type of light, and excessive amounts of ultraviolet can cause skin cancer and in general, skin damage. Therefore, use of the present invention is desired because it limits ultraviolet exposure to a very small portion of an individual—his or her fingernails and surrounding hand.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fingernail gel curation apparatus comprising:

an enclosure, means for insertion of an individual's hand into the enclosure, a plurality of ultraviolet lights located within the enclosure, power means to provide power to the light located within the enclosure, wherein the light is used to provide heat to the individual's hand wherein the enclosure further comprises:

a base, the base having a rectangular shape, a right upper door pivotally attached to the base, a left upper door pivotally attached to the base, wherein the apparatus further comprises:

a first pair of hinges, the first pair of hinges being used to allow the right upper door to be pivotally attached to the base, and a second pair of hinges, the second pair of hinges being used to allow the left upper door to be pivotally attached to the base, wherein the means for insertion of an individual's hand into the enclosure further comprises:

a first indentation in the left upper door, a second indentation in the right upper door, wherein folding both doors in an upward fashion causes the first indentation and the second indentation to form a central hole, wherein the hole is of sufficient size to allow an individual to place his or her hand through the central hole, wherein the apparatus further comprises:

an ultraviolet light located within the base, a glass covering located within the base, the glass covering designed to cover the ultraviolet light, wherein the ultraviolet light located within the base is connected to the power means to provide power to the lights located within the enclosure, wherein the apparatus further comprises means for controlling the power means to the ultraviolet light located within the base, wherein the means for controlling the power means to the ultraviolet light located within the base further comprises an on/off switch, the on/off switch acting as a circuit in between the power means and the ultraviolet light, the on/off switch itself being a two-position switch comprising an "on" position and an "off" position, wherein when in the "on" position, the switch acts as a closed circuit, thereby allowing power to travel between the power means and the ultraviolet light, thereby allowing the ultraviolet light to receive power and emit ultraviolet light, further wherein when in the "off" position, the switch acts as an open circuit, thereby preventing power from traveling between the power means and the ultraviolet light, thereby preventing the ultraviolet light from receiving power and emitting ultraviolet light, wherein the apparatus further comprises:

a second ultraviolet light, the second ultraviolet light being located within the left upper door, a second power source, the second power source being attached to the second ultraviolet light, the second power source providing power to the second ultraviolet light, and a first glass top located within the left upper door, the first glass top designed to cover the second ultraviolet light, wherein the apparatus further comprises:

a third ultraviolet light, the third ultraviolet light being located within the right upper door, a third power source, the third power source being attached to the third ultraviolet light, the third power source providing power to the third ultraviolet light, and a second glass top located within the right upper door, the second glass top designed to cover the third ultraviolet light, wherein the apparatus further comprises means for opening and closing the left upper door and the right upper door, wherein the means for opening and closing the left upper door and the right upper door further comprises:

a left knob attached to the left upper door, a right knob attached to the right upper door, wherein an individual can grasp the left knob and the right knob to open or close the left upper door and the right upper door.

* * * * *